US005688346A

United States Patent [19]

Corbusier

[11] Patent Number: 5,688,346

[45] Date of Patent: Nov. 18, 1997

[54] EVENT BOOSTER ITEM FOR AUTOMOTIVE VEHICLE PAINTED SURFACE

[76] Inventor: Bill Corbusier, 3450 Ranch View Ct., Fort Worth, Tex. 76109

[21] Appl. No.: 473,086

[22] Filed: Jun. 7, 1995

[51] Int. Cl.[6] ..... B44F 3/00

[52] U.S. Cl. ..... 156/60; 428/31; 428/79

[58] Field of Search ..... 428/31, 79, 7; 156/60

[56] References Cited

U.S. PATENT DOCUMENTS

| | | | |
|---|---|---|---|
| 2,632,269 | 3/1953 | Sanders | 428/31 X |
| 3,914,521 | 10/1975 | Beatty et al. | 428/461 |
| 4,233,331 | 11/1980 | Lemke et al. | 428/99 X |
| 4,358,488 | 11/1982 | Dunklin et al. | 428/79 X |
| 4,400,419 | 8/1983 | Laczynski | 428/79 X |
| 5,270,088 | 12/1993 | Grasse | 428/31 X |
| 5,382,473 | 1/1995 | Musclow et al. | 428/353 |

OTHER PUBLICATIONS

3M Technical Information Bulletin, Aug. 1994, "Scotch™ band No. 2476 R.V. Transit Tape".

Kansai Paint Co., Ltd. Bulletin, Aug. 1994, "Rapgard–F".

*Primary Examiner*—Henry F. Epstein

*Attorney, Agent, or Firm*—Jones, Day, Reavis & Pogue

[57] ABSTRACT

An article of entertainment for use as an event booster device and temporary placement on a painted metallic surface. The article of entertainment includes a first pliable sheet of material having a from and back side and having a humorous depiction printed on the front side. An adhesive-type material is placed on the back side of the first sheet to allow the first sheet with its indicia to be placed on a vehicle painted metallic surface for viewing and then removed without damaging the painted surface or leaving a residue thereon. A second sheet may be removably attached to the back side of the first sheet as a backing sheet to prevent adhesion of the first sheet to a surface until ready for use when it is then removed from the backing sheet.

8 Claims, 1 Drawing Sheet

EVENT BOOSTER ITEM FOR AUTOMOTIVE VEHICLE PAINTED SURFACE

BACKGROUND OF THE INVENTION

1. Field of the Invention

The present invention relates in general to entertainment devices and in particular to an event booster device in the form of a decal that can be separated from a backing sheet and attached to a metallic surface such as the hood over the engine compartment of an automobile or on the outside door panels of the automobile. In this manner, the event booster device can be viewed for a particular period of time and then removed from the painted metallic surface without damaging the painted surface or leaving a residue thereon.

2. Description of Related Art

Decals are well known in the art and are used for a multitude of purposes. The decal may have names, messages, pictures, and the like that have a first sheet with a type of adhesive that will allow it to be removed from a backing sheet and then attached to a surface such as dotting and the like.

However, such decals have never been placed on painted metallic surfaces such as automobile bodies because they either damage the paint when they are attempted to be removed or they leave a residue thereon that is difficult to remove.

It would be advantageous to have an event booster device in the form of a decal with an event-supporting depiction printed on one side and an adhesive on the other side that would allow it to be placed on a painted metallic surface such as an automobile body and then, after use, be removed without damaging the painted surface or leaving a residue thereon. In such cases, for example only, a decal several feet long could be made illustrating a football player with tire tracks running across the body and having words thereon such as "Run over the XYZ" where "XYZ" could be the name of the opposing team. Such decal could be placed on the hood, the side door panels, or the rear trunk portion of the automobile prior to and during the game and then, after the game it could be removed and discarded without damaging the automobile paint or leaving a residue thereon which is difficult to remove. Thus the event booster devices or decals could be made so that at any game of football, soccer, basketball, golf, and the like, supporters of one team could place the devices on their vehicles representing the opposing team being beaten. After the game is over, the decals or event booster devices could be simply removed from the painted metallic surface of the automobile without either damaging the paint or leaving a residue thereon. Obviously, any type of message desired could be placed on the decal.

SUMMARY OF THE INVENTION

Thus the present invention relates to the use of an article of entertainment such as an event booster device that has indicia on one side and adhesive on the other that allows the device to be placed on a painted metallic surface of an automotive vehicle and then later removed without either damaging the paint or leaving a residue thereon. The device is formed on a first sheet having the adhesive on the back side and the indicia or visual representation on the front side and is removably attached to a second backing sheet that prevents the adhesive from adhering to a surface until ready for use when it is removed from the backing sheet. Either a general outline of the indicia, such as a sports figure, may be cut into only the first sheet such that the outlined indicia can be removed from the remainder of the first sheet as well as from the backing sheet for placement on a surface or may include an area larger than the indicia including the entire first sheet or an area that is cut into only the first sheet such that a background area surrounding the indicia can also be removed. The color of the background on the front side of the first sheet on which the indicia is placed may be such as to match the color of the paint on the metallic surface on which the indicia is to be placed, thus causing the indicia to stand out or have its visibility increased against the metallic surface. The adhesive should be of a type that will adhere to the metallic surface at wind speeds up to at least 80 miles an hour. The device may be placed on the hood over the engine compartment, on the door panels of an automobile, or on the trunk cover. The material from which the first sheet is made is a polypropylene multipolymer film having a cross-linked acrylic on the back side as the adhesive.

Thus it is an object of the present invention to provide an article of entertainment such as an event booster device having a first sheet with a front and back side and having a humorous depiction or other indicia printed on the front side of the sheet and an adhesive placed on the other side with the adhesive being of a type such as cross-linked acrylic that will allow the first sheet to be adhered to a painted metallic surface and then later removed without either damaging the paint or leaving a residue thereon.

It is another object of the present invention to provide an article of entertainment having a humorous depiction thereon and that can be removably attached to a painted metallic surface.

It is still another object of the present invention to provide an article of entertainment that can be removably attached to a painted metallic surface such as a motor vehicle and having a humorous depiction thereon relating to an athletic event or an event such as Christmas, the Fourth of July, or Valentine's Day.

Thus the present invention relates to the use of an article of entertainment including a first pliable sheet with a front and back side and having indicia printed on the front side. An adhesive-type material is placed on the back side of the first sheet for allowing the sheet to be placed on a painted metallic surface with the indicia facing outwardly for viewing. The first sheet can then be removed without damaging the painted surface or leaving a residue thereon. A second sheet is removably attached to the back side of the first sheet as a backing sheet to prevent adhesion of the first sheet to a surface until ready for use when it is then removed from the backing sheet.

BRIEF DESCRIPTION OF THE DRAWINGS

These and other features of the present invention will be more fully disclosed when taken in conjunction with the following DETAILED DESCRIPTION OF THE DRAWINGS in which like numerals represent like elements and in which.

DETAILED DESCRIPTION OF THE DRAWINGS

Figure 1:
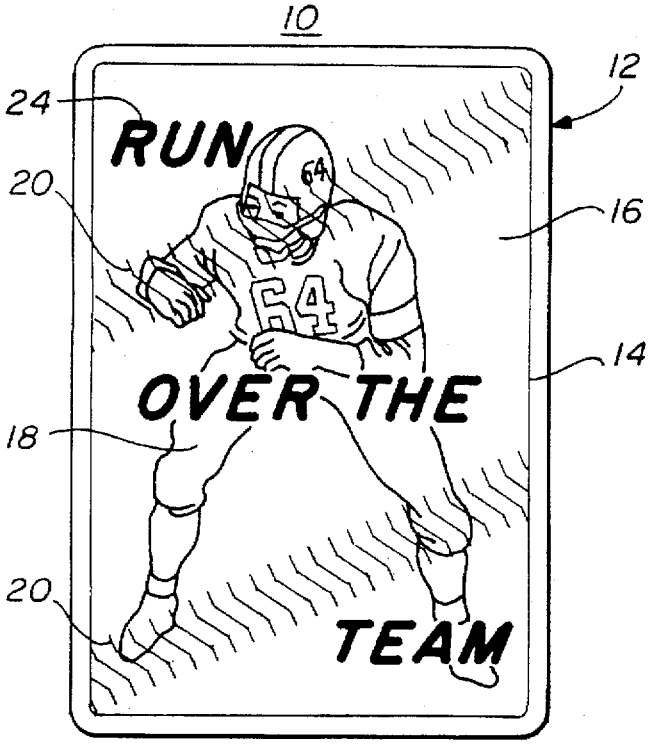
FIG. 1 is a plan view of a sample of a novel article of entertainment used in the present invention.
Figure 4:
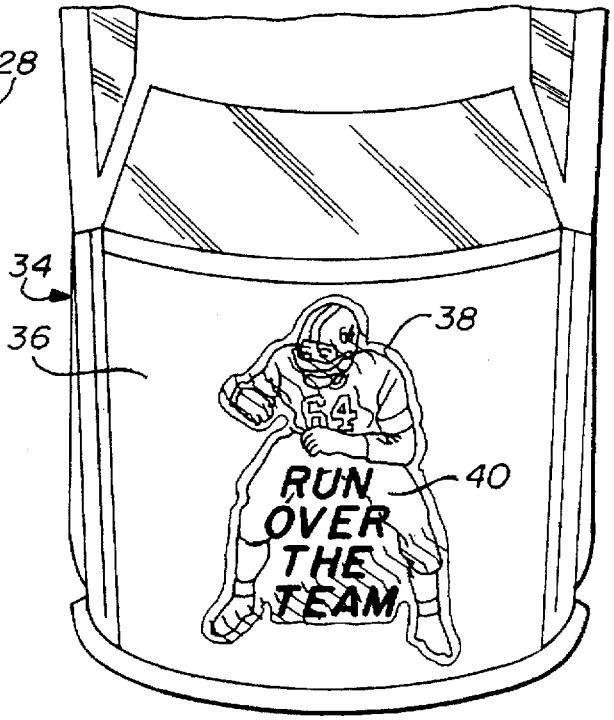
FIG. 4 illustrates the novel article of entertainment in use on the hood surface of an automobile.

FIG. 1 is a plan view of the novel article of entertainment to be used as shown in FIG. 4. The article 10 includes a first sheet 12 having a removable portion 14 on which is a humorous depiction or other indicia 16. The indicia 16 may include the outline of a sports FIG. 18 such as a football player having the imprints 20 of vehicle tires running over the player with the words "Run over the XYZ", where "XYZ" may be the name of a team such as the "Cowboys". Clearly, the humorous depiction or other indicia could also be any type of representation of any sports player or any other desired depiction or other indicia that would boost a particular event. For instance, a Santa Claus could be depicted at Christmas.

Figure 2:
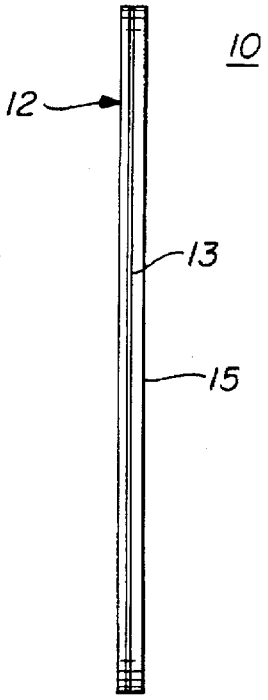
FIG. 2 is a side view of the article of entertainment of FIG. 1.

FIG. 2 is a side view of the novel article of entertainment for use on automotive vehicles and shown in FIG. 1 and illustrating that the article 10 comprises a first sheet 12 having a front and back surface and a second sheet 15 which serves as a backing sheet. A layer of adhesive 13 is formed on the back side of the first sheet 12 and removably adheres the first sheet 12 to the back sheet 15 to prevent adhesion of the first sheet to a surface until ready for use when it is then removed from the backing sheet 15. Instead of that portion 14 shown in FIG. 1 being removable from the first or top sheet 12, clearly, the entire top portion 12 could be removed from the backing sheet 15 if desired.

Figure 3:
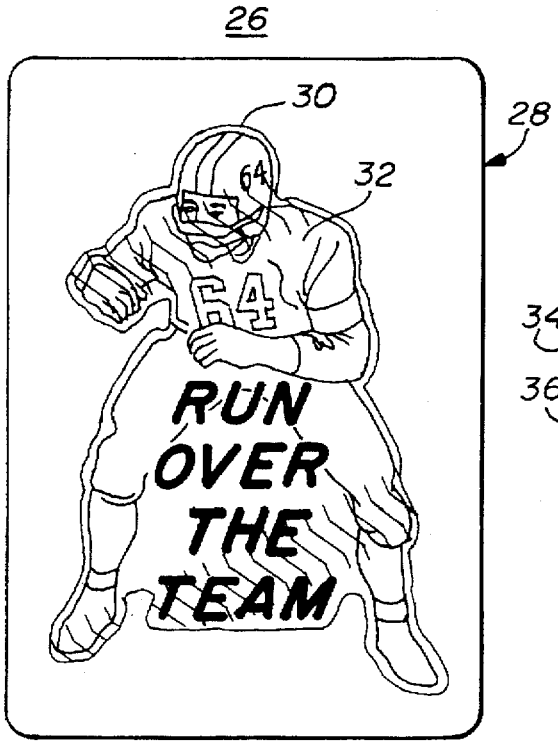
FIG. 3 is an alternate embodiment of the novel article of entertainment of FIG. 1.

Further, as shown in FIG. 3, if it is desired, a general outline 30 of the indicia 32 may be cut into only the first sheet 28 of the article of entertainment 26 such that the indicia outline 30 can be removed from the remainder of the first sheet 28 and the backing sheet 15 for placement on a surface.

The type of material from which the first sheet is formed is well known and is used in the prior art to protect painted metallic surfaces such as vehicle surfaces and may be a well-known polypropylene multipolymer film with the adhesive 13 being a cross-linked acrylic. Such material is known as R.V. Transit Tape and sold by 3M as Scotch™ brand No. 2476. It may also be a material known as Rapgard-F made by Kansai Paint Co., Ltd. and formed of a polyolefin film including polypropylene, polyethylene, titanium dioxide, and additives in trace amounts. The synthetic rubber adhesive 13 is polyisobutylene. In order to print indicia on this type of material, the surface to receive the priming, must be, first, corona treated, a process well known in the printing art. Printing of the indicia thereon can then take place.

FIG. 4 illustrates the use of the protective covering as an event boosting device and is shown placed on the front portion 34 of an automobile with the hood portion 36 covering the engine compartment and having the first sheet 38 being generally in the form of the image of an individual on which the indicia 40 has been printed and the first sheet 38 placed on the hood of the automobile as the event boosting device.

Thus, there has been disclosed a novel article of entertainment for use as an event booster device that includes a first pliable sheet with a front and back side and having indicia printed or otherwise placed on the front side. An adhesive-type material is placed on the back side of the first sheet for allowing the indicia to be placed on a painted metallic automobile surface for viewing and then removed without damaging the painted surface or leaving a residue thereon. A second sheet is removably attached to the back side of the first sheet as a backing sheet to prevent adhesion of the first sheet to a surface until ready for use when it is then removed from the backing sheet. A general outline of the indicia may be cut into only the first sheet such that the indicia outline can be removed from the remainder of the first sheet and from the backing sheet for placement on a surface. The first sheet is formed of a polypropylene multipolymer film having a cross-linked acrylic on the back side as the adhesive.

There has also been disclosed a process for using a protective covering for painted metallic surfaces as an event boosting device wherein the protective covering includes a first pliable sheet with a front and back side, an adhesive-type material on the back side of the first sheet for allowing the first sheet to be adhered to a painted metallic surface and then removed without either damaging the paint, or leaving a residue thereon, and a second sheet removably attached to the back side of the first sheet as a backing sheet to prevent adhesion of the first sheet to a surface until ready for use when it is then removed from the second sheet. The process includes the steps of corona treating the front side of the first sheet to enable printing of indicia thereon; printing event-promoting indicia on at least a portion of the first side of the first sheet; cutting a general outline of the indicia, which may be a humorous depiction, into only the first sheet; removing that portion of the first sheet having, the indicia general outline from the remainder of the first sheet and from the backing sheet; attaching the removed portion of the first sheet containing the indicia on a painted metallic surface for viewing, and removing the attached portion of the first sheet from the painted metallic surface without either damaging the painted surface or leaving a residue thereon. The process may also include a step of forming the first sheet of a polypropylene multipolymer film having a cross-linked acrylic on the back side as the adhesive.

While the invention has been described in connection with a preferred embodiment, it is not intended to limit the scope of the invention to the particular form set forth, but, on the contrary, it is intended to cover such alternatives, modifications, and equivalents as may be included within the spirit and scope of the invention as defined by the appended claims.

I claim:

1. A process for promoting a specific event comprising the steps of:

printing promotion indicia for a specific event on the front side of a first pliable sheet having a front side and a back side;

placing an adhesive material on the entire back side of said first sheet, said adhesive enabling the indicia-carrying first sheet to be attached to and removed from a surface without damaging the surface or leaving a residue thereon; and attaching the entire back side of the indicia-carrying first sheet to said surface with the adhesive to prominently display the specific event promotion indicia on the first side such that the indicia-carrying first sheet can be removed from the surface in one piece after the occurrence of said specific event.

2. A process as in claim 1 further comprising the step of attaching a removable second sheet to the back side of said indicia-carrying first sheet as a backing sheet to prevent adhesion of the first sheet to any surface until said first sheet is removed from said second sheet.

3. A process as in claim 2 further comprising the steps of:

forming said indicia-carrying first sheet of a polyolefin film; and corona treating the front side of said polyolefin film prior to printing the specific event promotion indicia thereon.

4. A process as in claim 2 further including the steps of:

printing as said promotion indicia on the front side of said first sheet a humorous depiction relating to said specific event; and cutting a general outline of said humorous depiction into only the first sheet such that only the humorous depiction outlined can be removed from the second sheet for attachment to said surface.

5. A process as in claim 4 further including the step of printing a humorous depiction of a member of a sports team as said promotion indicia.

6. A process as in claim 1 further comprising the step of attaching said entire back side of said indicia-carrying first sheet to a painted vehicle surface such that the front side prominently displays the specific event promotion indicia.

7. A process as in claim 6 further comprising the step of using a cross-linked acrylic as said adhesive on the entire back side of said indicia-carrying first sheet such that said indicia-carrying first sheet will adhere to said painted vehicle surface at wind speeds up to at least 80 miles per hour.

8. A process as in claim 1 further comprising the step of attaching said entire back side of said indicia-carrying first sheet to a painted metallic vehicle hood over an engine compartment such that the front side prominently displays the specific event promotion indicia.

* * * * *